United States Patent [19]

Röck et al.

[11] 4,227,750

[45] Oct. 14, 1980

[54] PULL-OUT GUIDE FOR DRAWERS

[75] Inventors: Erich Röck, Höchst; Bernhard Mages, Dornbirn, both of Fed. Rep. of Germany

[73] Assignee: Julius Blum Gesellschaft m.b.H., Höchst, Austria

[21] Appl. No.: 956,998

[22] Filed: Oct. 31, 1978

[30] Foreign Application Priority Data

Nov. 17, 1977 [AT] Austria ..... 8203/77

[51] Int. Cl.[3] ..... F16C 29/04; A47B 88/04

[52] U.S. Cl. ..... 308/3.8; 312/339

[58] Field of Search ..... 308/3.6, 3.8; 312/333, 312/337, 339, 340, 341R, 342, 348

[56] References Cited

U.S. PATENT DOCUMENTS

| | | | |
|---|---|---|---|
| 2,859,070 | 11/1958 | Gomersall | 308/3.8 |
| 2,869,961 | 1/1959 | Gomersall | 312/339 |
| 3,464,744 | 9/1969 | Fall | 312/340 |
| 3,860,308 | 1/1975 | Burke | 308/3.8 |

FOREIGN PATENT DOCUMENTS

| | | | |
|---|---|---|---|
| 2601669 | 7/1977 | Fed. Rep. of Germany | 312/341 R |

*Primary Examiner*—Richard R. Stearns

*Attorney, Agent, or Firm*—Wenderoth, Lind & Ponack

[57] ABSTRACT

A withdrawal guide for drawers or the like, where the drawer has two external sides, for use in a fixed structure, the latter having two internal sides, includes two support rails, one each disposed on a respective of the fixed structure sides, two guide rails, one each disposed on a respective external side of the drawer, and two mobile units. Each mobile unit includes at least two rollers. Each of the rollers is supported between a corresponding guide and support rail for taking up vertical forces. The support rails and/or the guide rails have a stop for the mobile units and the rail in which the mobile unit is held has a cut-out. Each mobile unit is formed with at least one stop forming a fixed part of the mobile unit, and the stop may be engaged with the cut-out in the track in which the mobile unit is held, when the drawer is pulled out from the fixed structure for securing the mobile unit in the inward-movable direction of the withdrawal guide. The support or guide rail has a frontal zone, and either a rail frontal zone or the mobile unit includes a safeguard against tilting of the mobile unit.

13 Claims, 6 Drawing Figures

PULL-OUT GUIDE FOR DRAWERS

BACKGROUND OF THE INVENTION

1. Field of the Invention

The invention relates to a pull out guide for drawers or the like and includes one supporting rail and one pull-out rail on each side of the drawer and at least two rollers or the like taking vertical forces arising between the pull-out rail and the supporting rail and being mounted in a roller carrier.

2. Description of the Prior Art

Such pull-out guides are widely used with drawers, shelves and the like in modern furniture production and particularly in kitchen furniture production.

In general the purpose of such guides is to facilitate the moving of the drawer and to avoid any obstructions during this movement.

In addition to known drawer guides which comprise rollers or slides, the rollers and slides being fixed directly to the supporting and pull-out rails, an increasing number of pull-out guides for drawers have been used lately in which, as mentioned above, the rollers are carried by a cage or the like and float between the supporting and pull-out rails.

SUMMARY OF THE INVENTION

It is the object of the present invention to provide a pull-out rail of the above-mentioned kind in which the roller carrier or carriage is locked when the drawer is pulled out or almost fully pulled out (i.e. when the drawer is pulled out of the body of the piece of furniture to such an extent that it just still engages the supporting rail on the side of the body, and if further pulled out the drawer would be lifted off the body rail) so that the carriage cannot unintentionally be moved forwards or backwards in the rail and that the carriage is prevented from tilting if a U-shaped rail is used as the supporting rail or pull-out rail. By means of the present invention high operational reliability can be obtained, and in particular it is possible to avoid the use of movable parts in the securing mechanism.

It is very important to prevent the carriage from tilting laterally. In general the prior art rail in which the carriage is guided, which rail can either be the pull-out rail or the supporting rail, has a C-shaped profile, whereby the outer edges of the rail embrace the carriage, thus keeping the carriage securely in the rail. It is a disadvantage of this arrangement that the production of C-shaped profile rails requires complicated machines. Such a profile cannot be produced by means of a simple press, at least not in one operating cycle, because of the inward bent edges of the C-shaped profile rail. U-shaped profile rails are therefore preferred.

According to the invention securing of the carriage is achieved by providing projections on the upper and lower sides of the carriage, which projections are staggered with respect to one another in the pull-out direction, and by providing the horizontal faces of the supporting rail or of the pull-out rail with apertures into which the projections extend when the drawer is pulled out, the rail in which the carriage is mounted having at its rear end a stop for the carriage, such stop being, for example, formed by flaps which are bent out of the rail.

In order to keep the carriage securely locked, when the drawer is fully pulled out, an embodiment of the invention advantageously provides that at least one projection extending vertically has a further lateral projection which engages behind the rail when the vertical projection extends into the aperture in the supporting rail or pull-out rail. A further embodiment provides that further projections or protrusions are disposed on the lower and upper side of the carriage, which further protrusions are positioned between the first projection and extend in the same direction as the first projections and around which second projections the carriage can be tilted. A further embodiment provides that the carriage is mounted in the pull-out rail having a U-shaped profile and apertures for the first projections and that the supporting flange of the supporting rail is guided between the rollers.

A further embodiment provides that a stop is disposed at the front end of the supporting rail, such stop being pushed against a counter-stop and advantageously against a stop surface, when the drawer is pulled out of the body of the piece of furniture.

In this embodiment the locking of the carriage is also achieved by the stop on the rail.

A further embodiment provides that a stop for the positioning of the carriage is disposed at the rear end of the supporting rail and near the front end of the pull-out rail. Thus, the carriage is moved back into the correct position when the drawer is fully pushed in and the position of the carriage is adjusted, even though repeated opening of the drawer can easily cause a displacement of the carriage along the length of the rail.

BRIEF DESCRIPTION OF THE DRAWINGS

In the following an embodiment of the invention will be described in more detail with reference to of the drawings wherein:

FIG. 1 is a schematic side view of a pull-out guide according to the invention, the drawer being shown pushed in;

FIG. 5 is a sectional view of the pull-out guide according to the invention in the area of the carriage, the drawer being shown pushed in.

DESCRIPTION OF THE PREFERRED EMBODIMENTS

Figure 1:
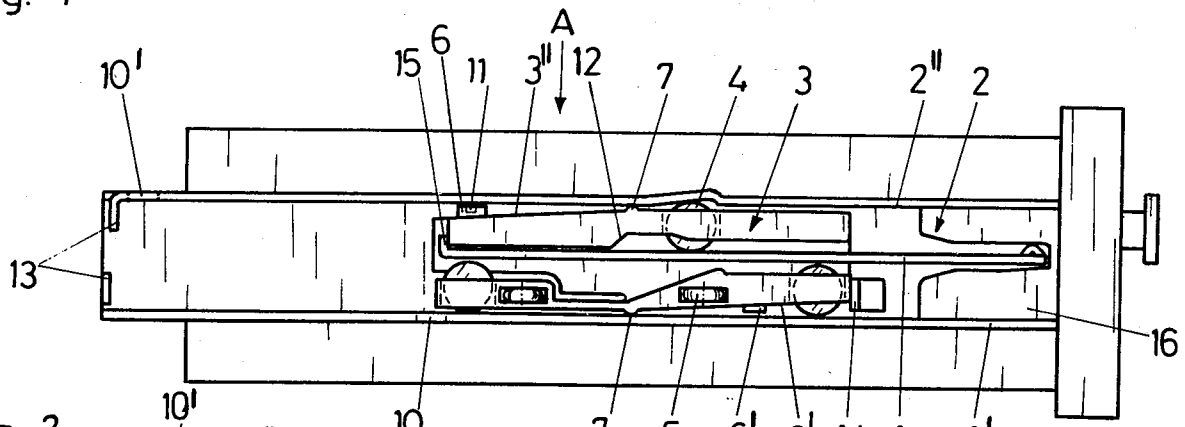

The pull-out guide according to the invention substantially comprises a supporting rail 1 on the side of a body, e.g. a furniture body, a pull-out rail 2 on the side of a drawer to fit into the body and a carriage 3. Load-transmitting rollers 4 are mounted in the carriage 3.

In the illustrated embodiment the rollers 4 are mounted with a certain clearance and without axles in the carriage 3, i.e. corresponding recesses and projections are laterally disposed in the carriage 3 and on the rollers 4, whereby the rollers 4 are kept in the carriage 3 but can be moved to a certain extent.

Also disposed in the carriage 3 are lateral compensating rollers 5 which are mounted in the same way as the rollers 4 and improve the lateral guiding of the drawer.

Figure 5:
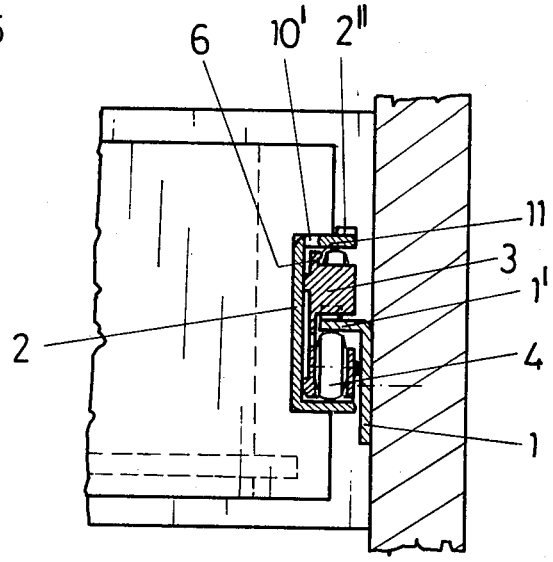

As can be seen in FIG. 5, the pull-out rail 2 on the side of the drawer has a U-shaped profile and the supporting rail 1 on the side of the body has an L-shaped profile. In this embodiment the carriage 3 is guided in the pull-out rail 2 on the side of the drawer.

The carriage 3 has on its lower side 3' and its upper side 3'' projections 6, 6', respectively, projection 6 being positioned near the rear end of the carriage 3 and projection 6' being positioned near the front end of the carriage 3.

Projections or protrusions 7 extending in the same directions as the projections 6 and 6' are disposed approximately in the center of the upper side 3'' and the lower side 3' of the carriage 3. The projections 7 are made to slide or almost slide on two parallel flanges 2', 2'' of the pull-out rail 2.

Figure 2:
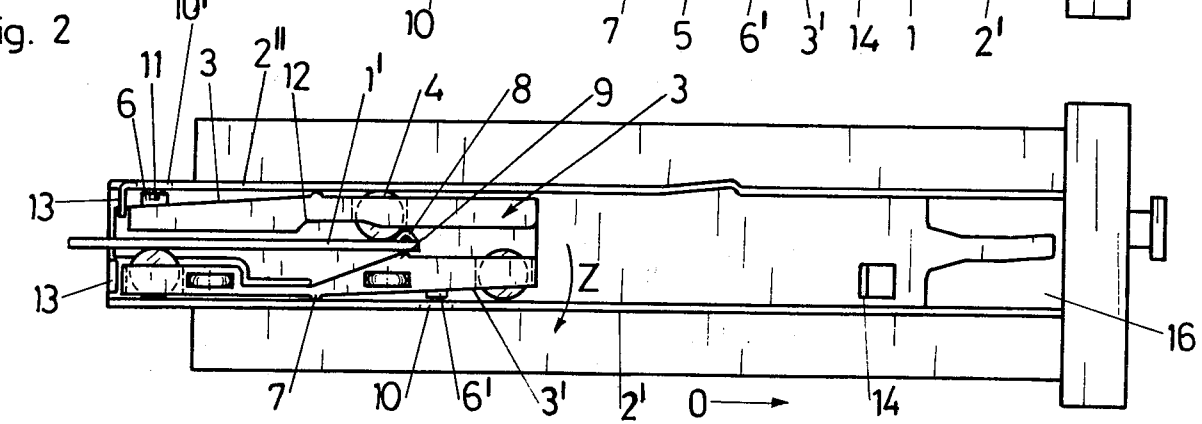
FIG. 2 is a side view similar to FIG. 1, the drawer being shown in its extreme pulled out position and still securely anchored in the rail of the body.
Figure 3:
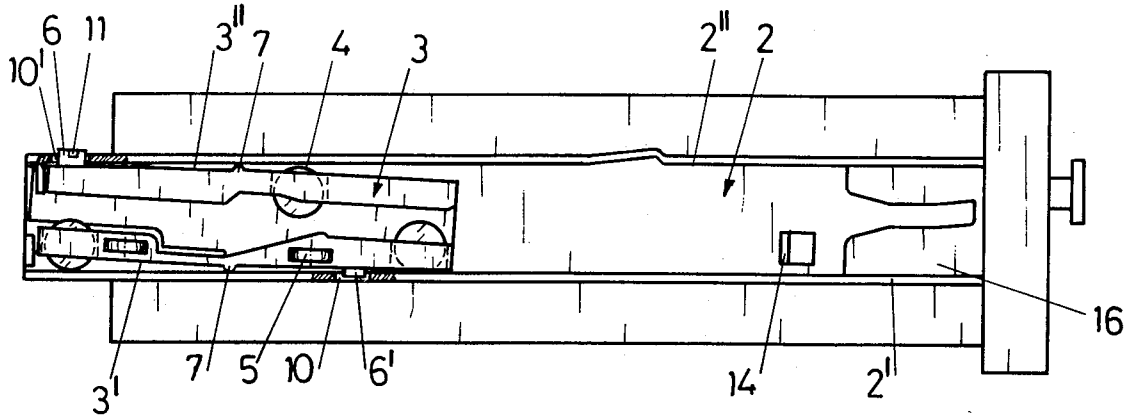
FIG. 3 is a side view similar to FIGS. 1 and 2, the drawer being shown fully pulled out.
Figure 4:
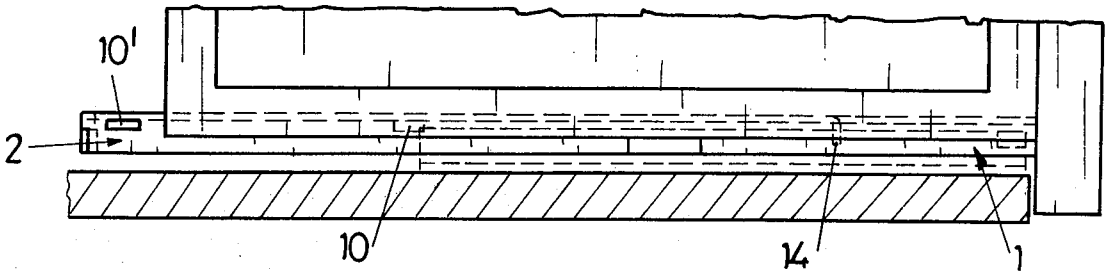
FIG. 4 is a view from the direction of arrow A in FIG. 1.

With the drawer being pushed into the body, i.e. if a horizontal flange 1' of the supporting rail 1 is positioned between the rollers 4, the projections 6, 6' are positioned within the U-shaped profile of the pull-out rail 2, and the carriage 3 is freely movable on the supporting rail 1 and in the pull-out rail 2, namely between the two final positions of the drawer illustrated in FIG. 1 and FIG. 2.

At the front end of the supporting rail 1 a stop 8 is disposed on the horizontal flange 1'. Stop 8 can, for example, be bent out of the horizontal flange 1' of the supporting rail 1.

When the drawer is further pulled outwardly from the position of FIG. 2, in the direction of arrow O in FIG. 2, the horizontal flange 1' of the supporting rail 1 presses against an underlying counter-stop 9 on carriage 3 when the stop 8 passes beneath an upper roller 4 of carriage 3. This causes the carriage 3 to move in the direction of arrow Z in FIG. 2, about a rotation axis formed by the lower projection 7. This movement pushes the projection 6' into an aperture 10, formed in the lower horizontal flange 2'. At the same time the upper projection 6 is pushed into an aperture 10' formed in the upper horizontal flange 2''. Thus, the carriage 3 is fixed in pull-out rail 2 and is prevented from tilting sideways as well as from rolling forward in the pull-out rail 2.

Figure 6:
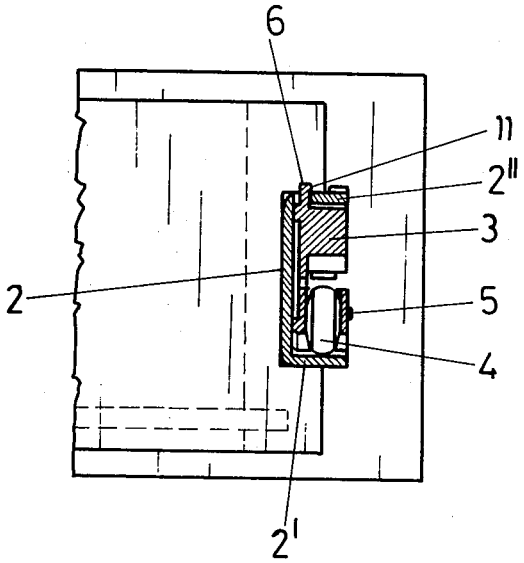
FIG. 6 is a sectional view similar to FIG. 5, the drawer being shown removed.

The upper projection 6 is additionally provided with a lateral projection 11 which engages behind the upper horizontal flange 2'' of the pull-out rail 2 when the drawer is in the pulled-out position (FIG. 6).

The locking of the carriage 3 is further improved by providing a stop surface 12 behind the upper roller 4 above the horizontal flange 1' of the supporting rail 1, thereby insuring that the projection 6 will be pushed into the aperture 10' when the stop 8 is pushed against stop surface 12.

In order to prevent the carriage 3 from being pulled out of the pull-out rail 2 in the backward direction and to provide resistance against the pull-out forces acting on the carriage 3 by means of the stop 8, when stop 8 is required for forcing the carriage 3 into the locked position, the pull-out rail 2 has at its rear ends a stop for the carriage 3. In the illustrated embodiment such stop is formed by flaps 13 bent out from the upper horizontal flange 2'' and from the vertical flange of pull-out rail 2.

The pull-out rail 2 also has at its front end a stop 14 formed by a flap punched out of the vertical flange, and the supporting rail 1 has at its rear end a stop 15 formed by the bent end of the horizontal flange 1'. Thus, the carriage 3 is always precisely positioned between the stops 15 and 14 when the drawer is fully pushed in.

The pull-out rail has at its front end a guiding device 16 for the height adjustment of the drawer, such device being positioned within the profile of the pull-out rail 2.

What is claimed is:

1. A pull-out guide assembly for use on each of opposite sides of a drawer in an article of furniture of the type wherein a drawer is slidably insertable into and removable from a furniture body, said pull-out guide assembly comprising:

a supporting rail and a pull-out rail adapted to be mounted on adjacent sides of the body and the drawer at positions to extend substantially horizontally and to be relatively longitudinally movable when the drawer is pushed into or pulled out from the body, said supporting rail and pull-out rail having respective vertically spaced and horizontally extending flanges;

at least two roller means, positioned for rolling contact on said horizontally extending flanges, for taking up vertical forces between said pull-out rail and said supporting rail when the drawer is positioned within the body;

said roller means being mounted within and supported by a carriage which is longitudinally movable with respect to said supporting and pull-out rails, said carriage comprising a single rigid and inflexible member extending longitudinally of said supporting and pull-out rails, said carriage and said rails being dimensioned such that said carriage is unitarily and completely tiltable in a single direction with respect to said rails about a horizontal axis transverse to the longitudinal direction of said rails only when said supporting rail and said pull-out rail are relatively longitudinally moved to a maximum drawer pull-out position;

plural locking means staggered in said longitudinal direction for locking said carriage in one of said rails when said rails are moved to said maximum drawer pull-out position, each said locking means comprising a projection and aperture provided on said carriage and said one rail in relative positions such that said projection extends into said aperture when said carriage is tilted about said axis; and said one rail having at an inner end thereof, with respect to the direction of movement of the drawer, stop means for limiting the relative longitudinal movement between said carriage and said one rail.

2. An assembly as claimed in claim 1, wherein said projections are on said carriage and said apertures are in said one rail.

3. An assembly as claimed in claim 2, wherein said carriage has on upper and lower surfaces thereof first and second separate said projections.

4. An assembly as claimed in claims 2 or 3, wherein at least one of said projections includes an additional lateral projection positioned to engage a horizontal surface of said one rail when said one projection extends into the respective said aperture in said one rail.

5. An assembly as claimed in claims 2 or 3, further comprising protrusions extending from said carriage, said carriage being tiltable about said protrusions, and said protrusions defining therebetween said axis.

6. An assembly as claimed in claim 1, wherein said pull-out rail is adapted to be mounted on the drawer and has a U-shaped configuration including upper and lower vertically spaced said horizontally extending flanges, said supporting rail is adapted to be mounted on the body and has a single said horizontally extending flange positioned vertically between said upper and lower flanges of said pull-out rail, said carriage is mounted between said upper and lower flanges of said pull-out rail, and said single flange of said supporting rail is guided for longitudinal movement between said roller means.

7. An assembly as claimed in claim 6, wherein said carriage has on upper and lower surfaces thereof first and second said projections, and said upper and lower flanges have therein first and second apertures, respectively.

8. An assembly as claimed in claim 7, wherein at least one of said first and second projections includes an additional lateral projection positioned to engage a horizontal surface of said upper and lower flanges, respectively, when said one projection extends through the respective said first and second aperture.

9. An assembly as claimed in claim 7, further comprising first and second protrusions extending from said upper and lower surfaces of said carriage, respectively, and abutting said upper and lower flanges, respectively, of said pull-out rail, said carriage being tiltable about said protrusions, and said protrusions defining therebetween said axis.

10. An assembly as claimed in claim 7, further comprising tilting means on said supporting rail and said carriage for imparting tilting movement to said carriage in said single direction about said axis, and for thereby causing said first and second projections to extend into said first and second apertures, respectively, when said pull-out rail is moved relative to said supporting rail to said maximum drawer pull-out position.

11. An assembly as claimed in claim 10, wherein said tilting means comprises a stop on an outer end of said supporting rail, with respect to the direction of movement of the drawer, said stop positioned to be depressed by one of said roller means when said pull-out rail is moved to said maximum drawer pull-out position, and a counterstop integral with said carriage at a position beneath said one roller means, such that depression of said stop causes depression of said counterstop, thereby causing tilting of said carriage.

12. An assembly as claimed in claim 11, wherein said tilting means further comprises a stop surface on said carriage at a position inward of said one roller means, with respect to the direction of movement of the drawer, said stop adapted to abut said stop surface and cause said tilting of said carriage.

13. An assembly as claimed in claim 6, further comprising means for positioning said carriage in a predetermined location with respect to said rails when said pull-out rail is longitudinally moved to a maximum drawer pushed-in position, said positioning means comprising first stop means on an inner end of said supporting rail, with respect to the direction of movement of the drawer, for engaging and pushing said carriage forwardly of said pull-out rail during movement of said pull-out rail toward the maximum drawer pushed-in position, and second stop means on an outer end of said pull-out rail, with respect to the direction of movement of the drawer, for abutting with said carriage and limiting the extent of movement thereof due to said first stop means.

* * * * *